United States Patent [19]

Crosman

[11] 4,311,311

[45] Jan. 19, 1982

[54] REPROJECTOR APPARATUS FOR PINBALL MACHINES

[75] Inventor: Dorland L. Crosman, Bloomfield, N.J.

[73] Assignee: Louis Marx & Co., Inc., Stamford, Conn.

[21] Appl. No.: 86,987

[22] Filed: Oct. 22, 1979

Related U.S. Application Data

[63] Continuation of Ser. No. 876,794, Feb. 10, 1978, abandoned.

[51] Int. Cl.[3] ..... A63D 13/00

[52] U.S. Cl. ..... 273/121 A; 200/61.11; 273/123 A; 273/129 V

[58] Field of Search ..... 273/123 A, 124 A, 125 A, 273/121 A, 127 C, 127 R, 129 V; 200/61.1, 61.11

[56] References Cited

U.S. PATENT DOCUMENTS

| | | | |
|---|---|---|---|
| 2,192,608 | 3/1940 | Butterworth | 273/129 V |
| 2,317,506 | 4/1943 | Williams et al. | 273/123 A |
| 2,864,620 | 12/1958 | Hooker et al. | 273/124 A |
| 4,212,465 | 7/1980 | Arad | 273/129 V X |

*Primary Examiner*—Anton O. Oechsle
*Attorney, Agent, or Firm*—Blum, Kaplan, Friedman, Silberman & Beran

[57] ABSTRACT

In a first embodiment, a steel ball traveling along the playing surface of a pinball machine may selectively drop through apertures into one of several aligned cups resulting in movement of the cups by gravity, the closing of a circuit for scoring and the operation of a mechanical linkage for causing rapid arcuate movement of the cups to "throw" the ball back into play.

3 Claims, 3 Drawing Figures

REPROJECTOR APPARATUS FOR PINBALL MACHINES

This is a continuation of application Ser. No. 876,794, filed Feb. 10, 1978 abandoned.

BACKGROUND OF THE INVENTION

Pinball machines have provided amusement for many years. Most machines are expensive to produce and are generally too expensive for home use on a wide scale. By providing simplified constructions and devices, it has become possible to produce pinball machines which operate in the manner of a commercial pinball machine and have good play value an yet can be produced at a price making them attractive for use in the home.

SUMMARY OF THE INVENTION

Generally speaking, in accordance with the invention, embodiments of two scoring devices are shown which can be relatively inexpensively fabricated and yet will perform for effective scoring and play value. One embodiment is in the form of a series of cups positioned below the playing surface for actuation of a scoring cycle when a ball falls into any of the cups and for concurrent operation of a throwing action for placing the ball back in play.

Another object of the invention is to provide an improved scoring apparatus which will throw a ball back into play in a pinball machine.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Pinball machines are well known in the prior art. They are generally constructed with a generally planar playing surface which slopes downwardly toward the player positioned at one end. The player projects a ball, usually a steel ball, along a raceway to the top of the playing surface. The ball then descends by gravity toward the player striking various obstructions along the way. Some of the obstructions are provided with means to close an electric circuit to make a "score" and the score of the player is cumulatively displayed on a display board. Many pinball machines have flippers or other devices by which the player can attempt to keep the ball in play. The longer each ball is kept in play, the higher the player's score is likely to be.

While expensive, commercial type pinball machines have been provided with expensive switch mechanisms, it has been necessary to develop constructions which will operate satisfactorily and yet can be produced at reasonable cost in order to be able to provide pinball machines for home use. Applicant's assignee has been marketing for several years a pinball machine wherein the playing surface is formed of a conductive sheet which forms a conductor of the scoring circuit. Bumper type devices which are also conductive are mounted in insulated relationship with the conductive playing surface. The bumpers are in series with the scoring device, the power source and the conductive playing surface and provide an open circuit arrangement. The ball for playing the game is made of a conductive material such as steel and when it strikes the conductive bumper while it is in contact with the conductive playing surface, it closes the circuit to register a score. A pinball machine with a conductive playing surface and a conductive bumper is shown in U.S. patent application Ser. No. 767,430 filed Feb. 10, 1977 and assigned to the assignee of the instant application. Ser. No. 767,430 is incorporated by reference herein for environmental purposes only, thereby to permit elimination from the disclosure of the present application commonly known components. The disclosure of the present application is designed so that one skilled in the art would be able to make the invention.

Figure 1:
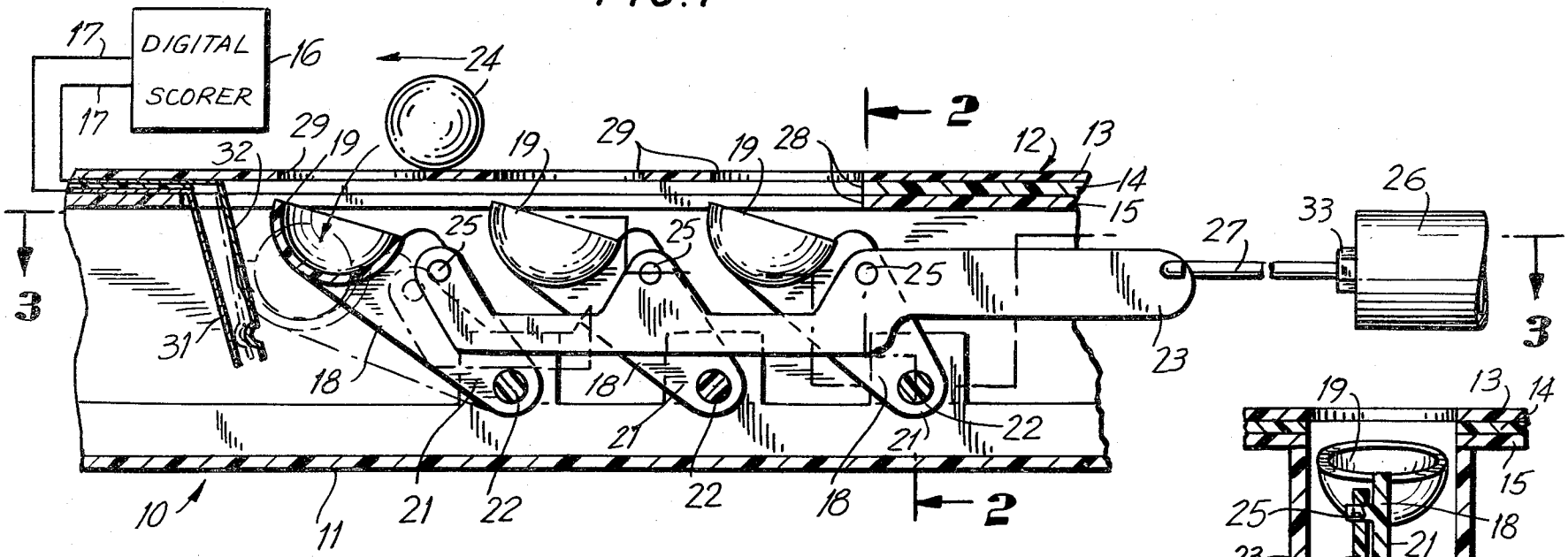
FIG. 1 is a partial sectional elevational view of a scoring apparatus constructed in accordance with a first embodiment of the instant invention.
Figure 2:
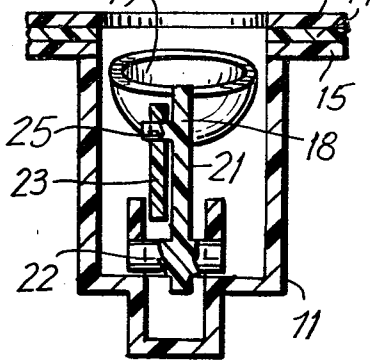
FIG. 2 is a partial sectional view taken along line 2—2 of FIG. 1.
Figure 3:
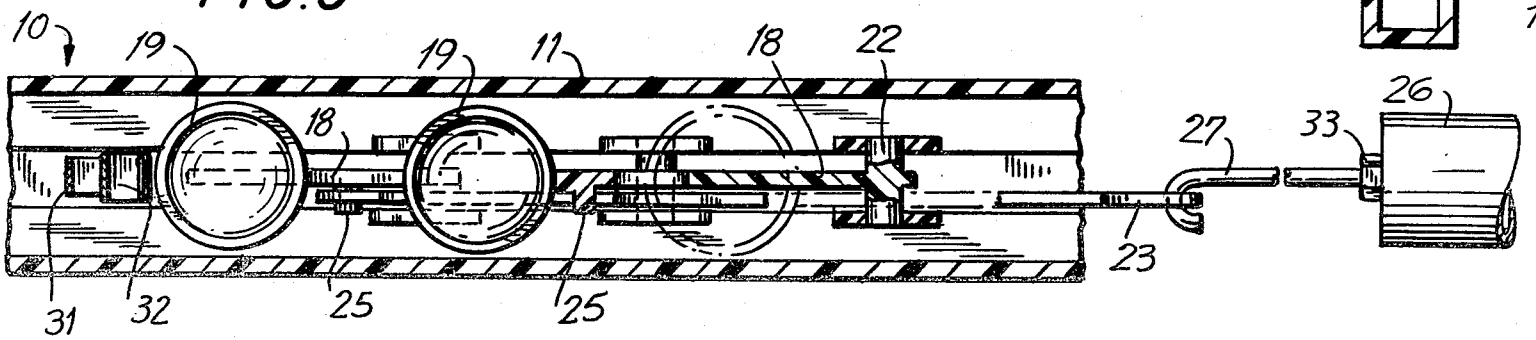
FIG. 3 is a partial sectional view taken along line 3—3 of FIG. 1.

Referring now to FIGS. 1 through 3, a pinball machine indicated generally at 10 is provided with a top wall 12 suitably mounted in a frame (not shown). The top wall 12 is formed of a sandwich layer consisting of an upper conductive plate 13 forming the playing surface, an intermediate insulated plate 14 and a lower conductive plate 15. The upper and lower conductive plates 13 and 15 are connected by means of suitable wires 17 to any type of electrically powered scoring device such as a digital scorer 16 or a mechanical scorer as shown in the aforesaid application Ser. No. 767,430. Any closure of the open circuit defined by spaced plates 13 and 15 is designed to effectuate a scoring cycle as is well known in the art.

Lower plate 15 carries a support member 11 to which the cup-like members of the embodiment of FIGS. 1 through 3 are pivoted. Each cup member 18 is formed with a cup 19 on one end of an arm 21. The other end of arm 21 is pivoted to frame 11 by means of a suitable pivot pin 22. An elongated link 23 lies adjacent each of the arms 21 and extends beyond the arms in a direction opposite to the normal ball travel as it rolls along playing surface 13. The normal direction is indicated by the arrow positioned above the ball 24. Each arm 21 is pivotally joined to link 23 by means of a suitable pivot pin 25. The extending end of link 23 is joined to a solenoid 26 by means of a rod 27.

In the area immediately above cups 19, the lower conductive plate 15 and the insulated plate 14 are cutaway as at 28 so as not to interfere with the operation of the cup members 18 as hereinafter described. Playing surface or upper conductive plate 13 is provided with an aperture 29 positioned immediately above each cup 19 and of sufficient diameter to readily pass spherical ball 24.

A pair of conductive spring members 31, 32 are respectively connected to lower conductive plate 15 and upper conductive plate 13. As shown in FIG. 1 in solid lines, the conductive spring members 31 and 32 are normally spaced one from the other. When deflected to the phantom line position, the conductive spring members make contact to close the circuit to scorer 16.

The normal position of link 23 is as shown in full lines in FIG. 1. When a ball moving in the direction of the arrow in FIG. 1 drops through an aperture 29, it is received in a cup 19. This immediately causes the cup member 18 and each of the associated cup members commonly pivoted to link 23 to rotate in a counterclockwise direction as shown by the arcuate arrow in FIG. 1. The left-most cup 19 as viewed in the Figure moves to the phantom line position and strikes conductive spring member 32 to close the circuit and register a score. Since all three cups are commonly linked, the entry of ball 24 into any of the cups 19 will result in a score.

Upon rotation of the cups in a counterclockwise direction, link 23 is moved toward the left to pull rod 27 and its associated armature 33 to the left. When the circuit controlled by conductive spring members 31 and 32 is closed by counterclockwise movement of the cups 19, an electrical circuit (not shown) controlling solenoid 26 is likewise closed to rapidly draw armature 33 into solenoid 26 and rapidly pull link 23 to the right through rod 27. This immediately moves each cup in the clockwise direction effectuating a throwing action. If ball 24 is resting in the right-most cup, it will be thrown up onto the playing surface 13 in a direction opposite to that of normal travel so as to re-enter play. If ball 24 is resting in either of the other cups, it will be thrown over the playing surface and enter the cup immediately to the right as shown in FIG. 1 so as to repeat the cycle of scoring and throwing.

In other words, a ball entering the left-most cup 19 will make a score and then be thrown to the middle cup where it will make a second score and be thrown into the right-most cup where it will make a third score and be thrown back into play.

While a series of three cups has been shown by way of illustration, it will be understood that any number of cups can be provided. It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An apparatus for a pinball machine comprising an inclined playing surface adapted to have a ball roll thereon in a first linear direction, a support member positioned entirely below said playing surface, at least a pair of ball receiving members positioned entirely below said playing surface and pivoted on said support member for coplanar pivotal movement, said ball receiving members being in substantial alignment in said first linear direction, actuating means connecting said ball receiving members for moving said ball receiving members in unison in a first arcuate direction opposite said first linear direction, circuit means supported below said playing surface and operable in response to movement of said ball receiving members in unison in a second arcuate direction opposite said first arcuate direction to actuate said actuating means, and a ball receiving aperture in said playing surface associated with each said ball receiving member, said ball receiving members and said associated ball receiving apertures being spaced a distance such that actuation of said actuating means may cause a ball projected from one of said ball receiving members to be thrown so as to traverse said playing surface and be received in the other of said aligned ball receiving members, each said ball receiving member comprising an arm pivoted at one end to said support member and a cup at the other end of said arm into which said ball is adapted to fall through said ball receiving aperture.

2. An apparatus as claimed in claim 1, wherein said actuating means includes a link, a solenoid for moving said link in a second linear direction opposite said first linear direction and pivot means pivoting each said arm to said link.

3. An apparatus as claimed in claim 2, wherein said circuit means includes at least one spring contact member and a second contact member normally disengaged, one from the other and positioned adjacent one of said ball receiving members for engagement thereby and deflection of said spring contact member into electrical engagement with said second contact member.

* * * * *